United States Patent [19]
Faulring et al.
[11] 4,317,678
[45] Mar. 2, 1982

[54] PROCESS FOR CONTINUOUS CASTING OF ALUMINUM-DEOXIDIZED STEEL

[75] Inventors: Gloria M. Faulring, Niagara Falls; Donald C. Hilty, Sanborn, both of N.Y.

[73] Assignee: Union Carbide Corporation, New York, N.Y.

[21] Appl. No.: 191,250

[22] Filed: Sep. 26, 1980

[51] Int. Cl.[3] ..... C21C 7/02
[52] U.S. Cl. ..... 75/58; 75/53; 164/473
[58] Field of Search ..... 75/51–58; 164/56

[56] References Cited

U.S. PATENT DOCUMENTS

| | | | |
|---|---|---|---|
| 3,253,307 | 5/1966 | Griffiths | 22/84 |
| 3,467,167 | 9/1969 | Mahin | 75/57 |
| 3,575,695 | 4/1971 | Miyashita | 75/57 |
| 4,117,959 | 10/1978 | Golas | 222/600 |

OTHER PUBLICATIONS

Steel Flow Through Nozzles: "Influence of Deoxidizers", by J. W. Farrell & D. C. Hilty, Electric Furnace Proceedings, AIME, vol. 29, 1971, pp. 31–46.
"Modification of Inclusions by Calcium", Iron & Steelmaker, ISS–AIME, 2 vols., (May, 1975), pp. 17–22 and (Jun., 1975), pp. 20–27.
"Mechanism of Clogging of Tundish Nozzle During Continuous Casting of Al-Killed Steel", by S. K. Saxena, et al., Scandinavian Journal of Metallurgy, vol. 7, 1978, pp. 126–133.
"Influence of Deoxidiation on the Castability of Steel", by K. H. Bauer, The Metals Society London, vol. 3, 1977.

*Primary Examiner*—P. D. Rosenberg
*Attorney, Agent, or Firm*—John R. Doherty

[57] ABSTRACT

Calcium or a calcium-bearing material is added to an aluminum-deoxidized steel in an amount which is sufficient to establish a calcium concentration exceeding the aluminum content by a value greater than about 0.14.

7 Claims, 12 Drawing Figures

NOZZLE PRECIPITATE OF $Al_2O_3$ $\frac{\% Ca}{\% Al} < 0.007$

NOZZLE PRECIPITATE OF $CaO \circ 6Al_2O_3$ $\frac{\% Ca}{\% Al} = 0.0085$ to $0.10$ NOZZLE PRECIPITATE OF $CaO \circ 6Al_2O_3$ (MAJOR) + $CaO \circ 2Al_2O_3$ $\frac{\% Ca}{\% Al} = 0.10$ to $0.12$ NOZZLE PRECIPITATE OF
$CaO \circ 2Al_2O_3$ (MAJOR)
$+ CaO \circ 6Al_2O_3$ $\frac{\% Ca}{\% Al} = 0.12$ to $0.13$

NOZZLE PRECIPITATE $\frac{\% Ca}{\% Al} = 0.11$ to $0.12$

Matrix (Light) Phase,
$CaO \bullet 2Al_2O_3$
$+ CaO \bullet 6Al_2O_3$

Primary (Dark) Phase,
$CaO \bullet 6Al_2O_3$ $CaO \circ 2Al_2O_3$ INCLUSION $\frac{\% Ca}{\% Al}$ 0.13 to 0.14

INGOT INCLUSIONS $\frac{\%\ Ca}{\%\ Al}$ – 0.15 to 0.20

Matrix (Light) Phase, $CaO \cdot 2Al_2O_3$ (Major) + $CaO \cdot Al_2O_3$

Dark Phase, CaS

INGOT INCLUSIONS $\frac{\%\ Ca}{\%\ Al}$ 0.15 to 0.20

Matrix (Light) Phase, Inclusion A, $CaO \cdot 2Al_2O_3$ (Major) + $CaO \cdot Al_2O_3$ Dark Phase, Inclusions A and B, CaS Matrix (Light) Phase, Inclusion B, $CaO \cdot 2Al_2O_3$ + $CaO \cdot 6Al_2O_3$

PROCESS FOR CONTINUOUS CASTING OF ALUMINUM-DEOXIDIZED STEEL

BACKGROUND OF THE INVENTION

The present invention relates to an improved process for continuous casting of aluminum-deoxidized steel.

It is common practice in the steelmaking industry to add a small amount of a strong deoxidizer to molten steel prior to casting in order to reduce the oxygen content and also to help produce a fine grain structure in the cast steel. Aluminum has been used as the deoxodizer for many years now and steels so produced are commonly refer to as "aluminum-deoxidized steel".

As a result of the oxidation process, deoxidized steels usually contain numerous tiny microscopic inclusions which are composed predominantly of refractory oxides, e.g., alumina. These microscopic inclusions may vary in size, type and distribution in both the molten and cast steel. It has been known for sometime that the microscopic inclusions greatly influence the flow of molten steel and in some instances may even cause blockage of tundish nozzles during the casting operation. In the past, this problem has been alleviated by reaming out the clogged nozzles with an oxygen lance or the like.

In recent years, there has been a growing tendency for steelmakers to adopt continuous casting methods in the manufacture of steel. These methods are far more economical when compared to conventional billet casting, for example, and can substantially reduce manufacturering costs. However, continuous casting of deoxidized steels has been seriously limited by the problem of nozzle blockage. It has been found in commercial practice that the entire casting operation must be periodically shut down in order to replace or repair clogged nozzles. This of course defeats the whole purpose of continuous casting methods.

In an article "Steel Flow Through Nozzles: Influence of Deoxidizors," by J. W. Farrell and D. C. Hilty, published in Electric Furnace Proceedings, AIME, Vol. 29, 1971, pages 31–46, it is suggested that the simplest solution to the problem of nozzle blockage is a chemical one in which the melting temperature of the oxide produced by the strong deoxiderizer would be lowered below that of the steel. It is postulated that by modifying the microscopic inclusions in this manner they would remain in solution rather than precipitate during casting as an oxide layer inside the nozzle where the temperature decrease is the most pronounced.

The same authors in a later article "Modification of Inclusions by Calcium," published in Iron and Steelmaker, ISS-AIME, two Volumes, 1975, (May), pages 17–22 and (June), pages 20–27, reported that in the case of aluminum-deoxidized steels, inclusion modification of this kind can be readily obtained by the addition of calcium to the molten steel.

Subsequent articles have been published in this field which describe the benefical effects of adding calcium or calcium-bearing materials to deoxidized steels. See for example the article "Mechanism of Clogging of Tundish Nozzle during Continuous Casting of Aluminum-killed Steel", by S. K. Saxena et al, published in Scandinavian Journal Of Metallurgy, Vol. 7, 1978, pages 126–133. See also the article "Influence of Deoxidation on the Castability of Steel," by K. H. Bauer, published in The Metals Society London, Vol. 3, 1977, wherein it is suggested that calcium may be employed as the sole deoxidizer in place of aluminum. However, there have been no studies made so far directed to the effects of both calcium and the aluminum dixoidizer in the molten steel. For example, it has not been known until now whether calcium when added in amounts which have proven effective in some instances to avoid the problem of nozzle blockage will be equally as effective for the same purposes when added to a dixoidized steel in which the weight proportion of aluminum has been varied. It is known, for example, that the weight proportion of aluminum recovered in an aluminum dexoidized steel may vary in amounts up to about 35 percent or more in commercial production and in some cases as much as about 75 percent.

SUMMARY OF THE INVENTION

The present invention is directed to an improved process for continuous casting of an aluminum-dexoidized steel wherein calcium is employed in amounts which are effective to insure good flowability and to avoid any problems of nozzle blockage even though the aluminum content may vary in the molten steel during the casting operation. Broadly, the present invention is based upon the discovery that if a calcium or a calcium-bearing material is employed in amounts such that the calcium concentration in the molten steel exceeds a value of 0.14 times the aluminum content, precipation of solid oxide inclusions are effectively avoided and there is no problem of nozzle blockage. Further, it has been found that when the ratio of added calcium to aluminum content exceeds a value of about 0.22, the rate of flow of the molten steel approximates the superior flow characteristic of steels dexoidized with silicon and manganese.

The present invention therefore conprises an improved process for producing an aluminum-dexoidized steel. The improvement comprises adding to the molten steel prior to casting an amount of calcium or calcium-bearing material which is sufficient to establish a calcium concentration which exceeds the aluminum content by a value greater than about 0.14 and preferably 0.22. Stated in another way, the ratio of added calcium to aluminum should be greater than about 0.14 and preferably 0.22.

The present invention also comprises an improved process for continuous casting of an aluminum-deoxidized steel wherein an amount of calcium is added to the melt which is sufficient to prevent the formation of microscopic indigenous inclusions containing certain solid phases comprising $CaO.6Al_2O_3$, alone or in combination with other oxides. However, the presence of minor amounts of $CaO.6Al_2O_3$ up to about 2% by weight does not substantially effect nozzle flow.

FIGS. *6a* and *6b* are photomicrographs taken at 2000 times magnification of the two phases, e.g., matrix and primary phases, of typical oxide inclusions precipitated in tundish nozzles at calcium-aluminum ratios of from 0.11 to 0.12 along with corresponding intensity traces representing the inclusion chemistry of each phase.

Figure 7:
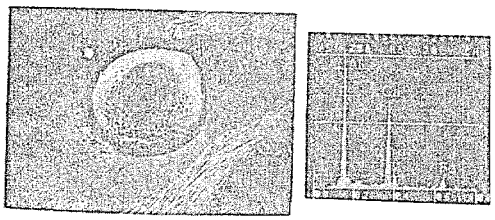

FIG. 7 is a photomicrograph taken at 2000 times magnification of typical oxide inclusions precipitated in tundish nozzles at calcium-aluminum ratios of from 0.13 to 0.14 along with a corresponding intensity trace showing the inclusion chemistry.

Figure 8:
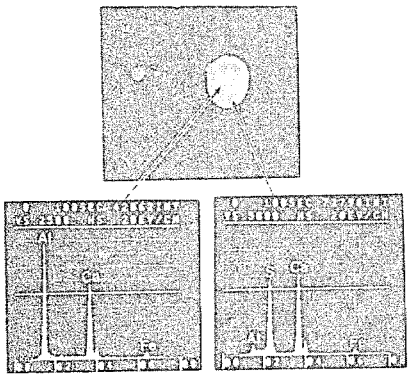
Figure 9:
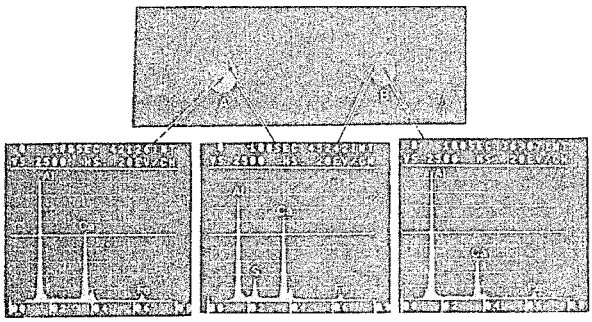
Figure 10:
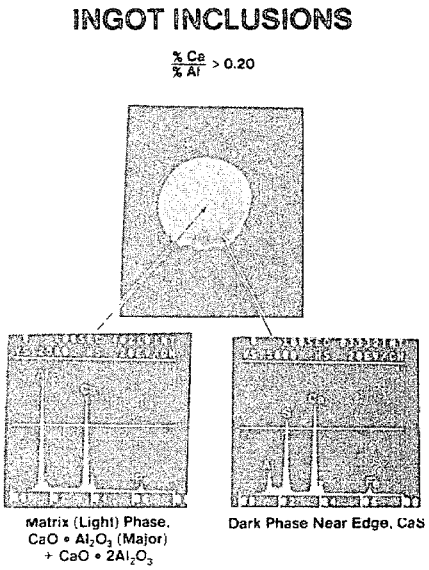

FIGS. 8–10, inclusive, are photomicrographs of typical oxide inclusions formed in solid ingots at different calcium-aluminum ratios of from 0.15 to 0.20 and greater along with the corresponding intensity traces showing the inclusion chemistry for the different phases. The photomicrographs of FIGS. 8 and 9 were taken at 1000 times magnification while the photomicrograph of FIG. 10 was taken at 2000 times magnification.

Figure 11:
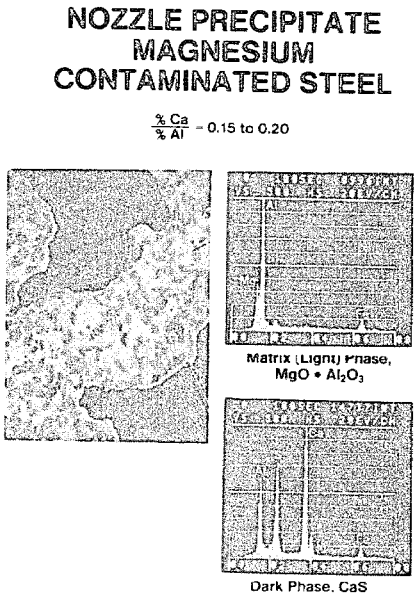

FIG. 11 is a photomicrograph taken at 1000 times magnification of typical oxide inclusions precipitated in tundish nozzles at calcium-aluminum ratios of from 0.15 to 0.20 in a magnesium contaminated steel.

Figure 12:
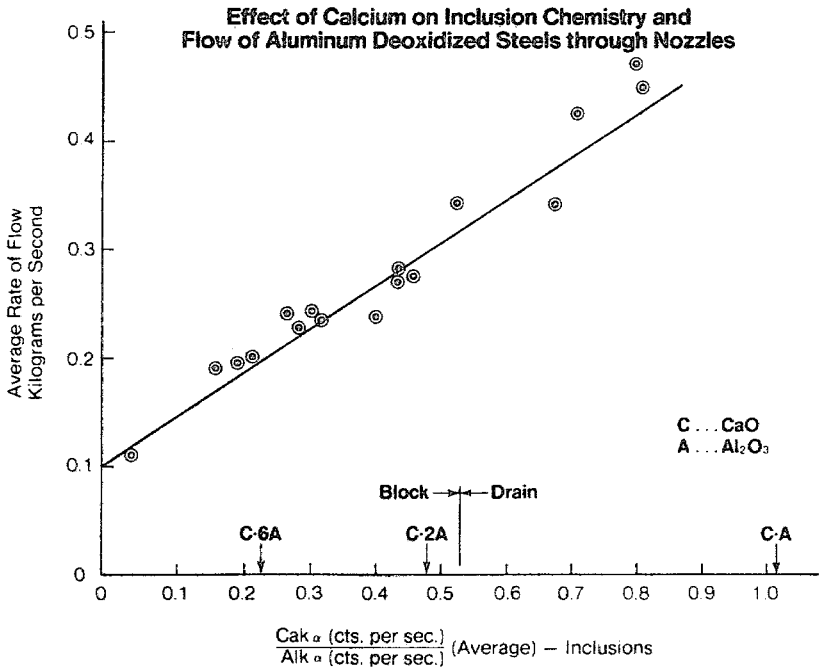
Figure 2:
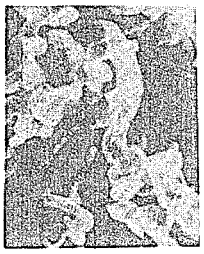
FIGS. 2–5 are photomicrographs of typically oxide inclusions precipitated in tundish nozzles at different calcium-aluminum ratios ranging from less than 0.007 to 0.13. The photomicrograph of FIG. 2 was taken at 3000 times magnification while the photomicrographs of FIGS. 3–5 were taken at 2000 times magnification.

FIG. 12 is a graph illustrating the relationship between the intensity ratios of calcium-aluminum (Ca$k\alpha$-/Al$k\alpha$) and the rate of steel flow.

DESCRIPTION OF THE PREFERRED EMBODIMENTS

The present invention provides an improved process for the production of aluminum-deoxidized steel by continuous casting methods. The methods for continuous casting of aluminum-deoxidized steel are well known to those skilled in the art. It is also well known in continuous casting of aluminum-deoxidized steel to add calcium or a calcium-bearing material to the melt in order to improve the flowability of the molten steel. The present invention contemplates an improved process for continuous casting of aluminum-deoxidized steel wherein the calcium or calcium-bearing material is added to the melt in amounts such that the calcium concentration in the molten metal exceeds a value of 0.14 times the aluminum content.

More specifically then, the present invention is directed to an improved process for continuous casting of an aluminum-deoxidized steel wherein the aluminum content in the molten steel is first estimated by practices well known in the art and an amount of calcium or calcium-bearing material is then added to the molten steel in order to establish a calcium concentration exceeding the aluminum content by a value greater than about 0.14. The so treated molten steel is then continuously cast into the desired shape by conventional continuous casting techniques. The estimation of aluminum content maybe made by the steel maker based on his own knowledge derived from past experiences with aluminum recoveries obtained from given aluminum additions and under specific operating conditions. Alternatively, if a pre-cast is practical, the aluminum content may be determined directly from a sample of the solidified steel.

The calcium may be added to the molten metal directly in the furnace melt or while in the tundish prior to casting and may be added as pure calcium or in the form of a calcium-bearing material. Suitable calcium-bearing materials for this purpose include Ca-Si, Ca-Ba-Si-Al, Ca-Ba-Si, $CaC_2$ and Ca-Al.

It has been found during experimentation leading to the present invention that the presence of sulfur in the molten metal in amounts as high as 0.028% by weight did not deleteriously affect the continuous casting of the steel, contrary to expectation. However, it was also found that the presence of magnesium in amounts exceeding about 6 parts per million tended to minimize the effects of the calcium due to the formation of $MgO.Al_2O_3$.

The present invention will be illustrated in greater detail by the following example:

Molten metal from a 136.1 kg (300 lb.) magnesia-lined induction furnace was cast into a preheated tundish that drained through a zirconia nozzle into a 17.8 cm (7 in.) square cast iron mold. The average flow rate was determined by measuring the time required to empty the furnace and drain the tundish into the ingot or for nozzle blockage to stop the casting, and then weighing the resulting ingot.

The initial charge in the magnesia-lined induction furnace was Armco iron. An inert atmosphere was obtained by feeding argon at a rate of 0.283–0.425 cu.m. (10–15 cu. ft.) per hour through a graphite cover. Additional protection from oxidation was provided by the reducing atmosphere generated by the heated graphite cover. After meltdown, the bath was deoxidized with silicomanganese added through the cover and, four minutes later, the slag was removed. The composition of the test heats was adjusted to a 1038 grade steel by adding carbon granules followed by silicon metal and electrolytic manganese. Previous studies suggested that sulfur might influence nozzle blockage and heats were therefore made with sulfur contents in the ranges of 0.017–0.021% and 0.023–0.028%.

When the furnace was stablized at about 1630° C. (2966° F.), the deoxidizers were added one minute before tap as a calcium-barium-silicon-aluminum alloy or aluminum followed by a calcium-barium-silicon-alloy. In the low calcium heats deoxidized with the calcium-barium-silicon-aluminum alloy, additional aluminum was added in order to obtain the required composition. The total amount of aluminum added to each heat was 0.06% and the calcium was varied from 0.01–0.1% in increments of 0.01%. These materials were encapsulated in steel foil attached to a steel rod and plunged to the bottom of the metal bath in the furnace. For comparison, simular heats were made of steels deoxidized with only silicon and manganese.

The tundish, a No. 10 clay-graphite Dixon crucible, was enclosed in a refractory-lined steel drum and preheated to about 1155° C. (2111° F.). The prefabricated zirconia nozzles were 3.2 cm. (1.25 in.) long with a 0.56 cm. (0.22 in.) diameter bore. The inlet of the nozzle was installed about 1.3 cm. (0.5 in.) above the bottom of the tundish in order to prevent any metal or refractory reaction products from washing into the nozzle opening.

When the cast was started, the nozzle was closed with a stopper rod while the tundish was filled. During casting, the metal was maintained within 1.27 cm. (0.5 in.) of the top of the 13.6 kg (30 lb.) capacity tundish until the furnace was emptied or until the casting was stopped by nozzle blockage. If the furnace drained, there was a ferrostatic head of 16.5–17.8 cm. (6.5–7 in.) for the first 122.5 kg (270 lb.) of the 136.1 kg (300 lb.) cast. Power was supplied to the furnace until 4.5–6.8 kg (10–15 lb.) of metal remained in the crucible. For each experimental melt, the time that the steel flowed through the nozzle and the weight of the ingot produced were measured.

Pintube samples were taken from the furnace one minute after the last addition and from the tundish immediately after the stopper rod was removed. Ingot specimens for metallographic examination and chemical analyses were taken from slices that measured 16 mm (0.63 in.) thick. These slices were removed from the ingots a distance of one-third up from the bottom. The pintube samples were analyzed for calcium, aluminum and sulfur; and the ingot specimens for carbon, silicon, manganese, calcium, aluminum and sulfur.

In addition, polished and polished-etched specimens of the ingots and nozzle deposits as well as calcium aluminate reference samples were examined on a scanning electron microscope (SEM) equipped with an energy dispersive analysis system.

The compositions of the experimental heats were within the ranges listed in Table I below.

TABLE I

Compositional Ranges of Experimental Melts

| Melt Series | % C | % Mn | % Si |
|---|---|---|---|
| 0.017–0.021% S | 0.31–0.44 | 0.68.0.91 | 0.19–0.36 |
| 0.023–0.028% S | 0.32–0.46 | 0.75.0.92 | 0.32–0.46 |

Specific calcium and aluminum analyses of the steels in the tundish and pertinent flow date are also tabulated in Table II.

Variables normally encountered in continuous casting such as nozzle geometry, flow pattern, velocity, temperature, etc., were maintained constant. As a result, the flow rate of the steels through the nozzles depended soley upon the deoxidation process.

TABLE II

Calcium and Aluminum Contents and Flow Data - Experimental Melts

| Melt Series | Tundis Ca ppm | Al % | Ingot Weight kg | Time of Flow sec. |
|---|---|---|---|---|
| 0.017–0.021% S | 2 | 0.034 | 36.7 | 180 |
| | 4 | 0.036 | 16.3 | 58 |
| | 4 | 0.034 | 13.2 | 55 |
| | 7 | 0.036 | 15.0 | 60 |
| | 23 | 0.038 | 12.2 | 75 |
| | 30 | 0.042 | 19.0 | 83 |
| | 29 | 0.034 | 10.0 | 39 |
| | 42 | 0.034 | 61.7 | 242 |
| | 43 | 0.039 | 60.0 | 209 |
| | 48 | 0.043 | 113.0 | 378 |
| | 52 | 0.045 | 84.0 | 353 |
| | 57 | 0.045 | 127.1 | 385 |
| | 58 | 0.043 | 127.0 | 460 |
| | 69 | 0.034 | 135.2 | 322 |
| | 77 | 0.047 | 133.4 | 275 |
| | 80 | 0.043 | 124.3 | 425 |
| | 91 | 0.041 | 135.6 | 355 |
| | 93 | 0.046 | 134.3 | 329 |
| | 95 | 0.034 | 133.4 | 266 |
| | 100 | 0.045 | 135.6 | 310 |
| Si—Mn | 0 | 0 | 131.1 | 288 |
| | 0 | 0 | 133.3 | 268 |
| | 0 | 0 | 134.7 | 280 |
| 0.023–0.028% S | 1 | 0.052 | 45.4 | 205 |
| | 3 | 0.045 | 37.6 | 187 |
| | 5 | 0.044 | 11.8 | 60 |
| | 9 | 0.044 | 15.0 | 61 |
| | 11 | 0.043 | 15.4 | 80 |
| | 15 | 0.039 | 10.0 | 43 |
| | 16 | 0.044 | 9.1 | 34 |
| | 23 | 0.043 | 21.8 | 80 |
| | 44 | 0.039 | 31.3 | 152 |
| | 53 | 0.042 | 71.2 | 230 |

TABLE II-continued

Calcium and Aluminum Contents and Flow Data - Experimental Melts

| Melt Series | Tundis Ca ppm | Al % | Ingot Weight kg | Time of Flow sec. |
|---|---|---|---|---|
| | 56 | 0.043 | 84.4 | 277 |
| | 72 | 0.039 | 133.4 | 285 |
| Si—Mn | 0 | 0 | 133.8 | 299 |

Since the flow of steel was terminated either by nozzle blockage or by emptying the furnace and tundish, the weights of the ingots produced are a measure of nozzle constriction. The relationship between nozzle constriction and deoxidation practice is illustrated in FIG. 1 where the ingot weights are plotted versus the ratios of the calcium and aluminum contents in the tundish.

The photomicrographs shown in FIGS. 2–11 inclusive illustrates a series of electron images of the microscopic inclusions precipitated in both the blocked nozzles and ingots. From these electron images, the changes in the inclusion morphology and composition that occur when the ratio of calcium and aluminum content in the tundish are increased can readily be observed. FIGS. 2–7 inclusive show oxide inclusions precipitated in the clogged nozzles while FIGS. 8–10 inclusive show oxide inclusions in the ingot specimens. FIG. 11 shows oxide inclusions precipitated in the clogged nozzles where the molten steel had been contaminated with magnesium. Intensity traces representing inclusion chemistry are also included in FIGS. 6–11. Referring to the data at the top of the intensity traces, the verticle scale (VS) indicates the number of counts required to reach the maximum of 10 on the intensity scale. Thus, the heights of these intensity traces are a measure of the amounts of the identified elements contained in a minute volume of the inclusion.

In the majority of the experimental melts, it was found that the microscopic inclusions were a closely associated mixture of two calcium alumninate phases as opposed to a single phase. Moreover, the relative amounts of each phase in these duplex inclusions frequently varied within narrow limits; however, the identity of the phases did not change except for the one ingot specimen illustrated in FIG. 9. In this specimen, the inclusions A and B are nearly identical in size and location in the the ingot but contain different phases. Consequently, an average of the ratios of the intensities, i.e., counts per second, of the CaKα and AlKα x-rays generated in several inclusions in each steel was used to represent the inclusion composition. When these values are plotted versus the average rate of steel flow, the relationship is linear as illustrated in FIG. 12. In other words, the rate of steel flow is controlled by and linearly related to the inclusion composition.

Figure 1:
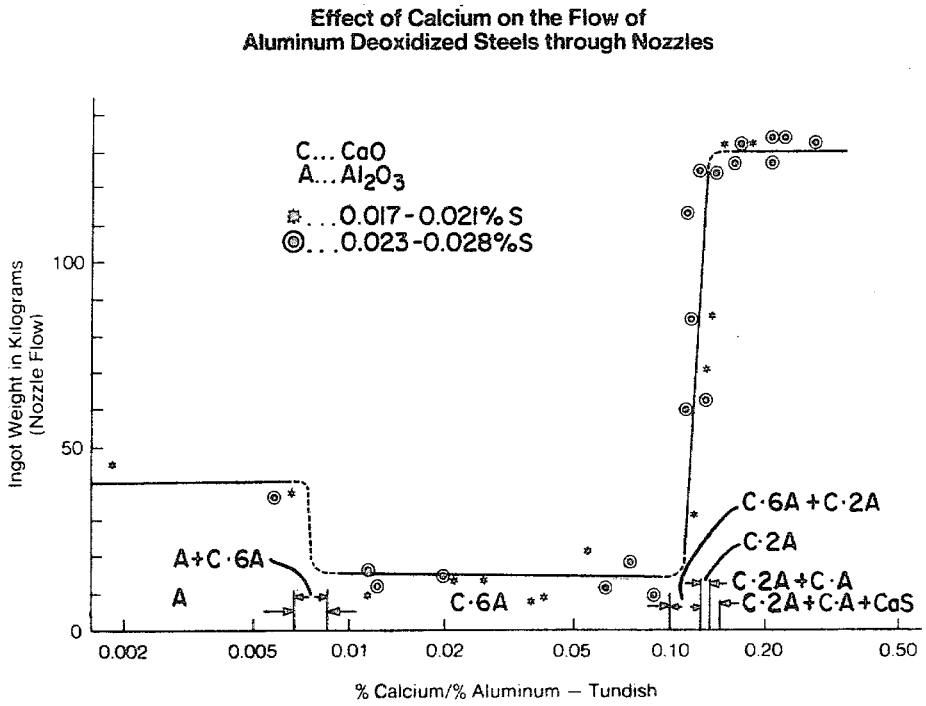
FIG. 1 is a graph illustrating the effects of calcium on the flow of aluminum-deoxidized steels through tundish nozzles when the calcium-aluminum ratio is varied in accordance with the present invention.

From the earlier work of Farrell and Hilty, supra, it was predicted in these experimental studies that the abrupt changes in ingot weights as shown in FIG. 1 should be related to the identities of the microscopic inclusion phases. In order to verify this, the calcium aluminate phases in the inclusions were identified and their relative amounts estimated. In addition, the simultaneous detection of calcium and sulfur established the presence of calcium sulfide. The results of these studies are summarized in Table III below.

TABLE III

| Calcium-Aluminum Ratios and Related Inclusion Phases | | | | | |
|---|---|---|---|---|---|
| % Ca:% Al (Tundish) | Ingot Wgt. (kg) | Time* (Seconds) | "Block-Drain" of Nozzle | Inclusion Identification Relative Amounts** Increase | Decrease |
| 0 → 0.007 | 40 | 190 | Block | $Al_2O_3$ | |
| 0.0070 → 0.0085 | 40 → 14 | 190 → 60 | Block | $CaO . 6Al_2O_3$ | $Al_2O_3$ |
| 0.0085 → 0.10 | 14 | 60 | Block | $CaO . 6Al_2O_3$ | |
| 0.10 → 0.13 | 14 → 127 | 60 → 390 | Block → Drain | $CaO . 2Al_2O_3$ | $CaO . 6Al_2O_3$ |
| 0.13 → 0.14 | 127 → 136 | 390 → 460 | Block → Drain | $CaO . 2Al_2O_3$ | |
| 0.14 → 0.28 | 133 → 136 | 360 → 270 | Drain | $CaO . Al_2O_3$ + CaS | $CaO . 2Al_2O_3$ |

*The times to cast 136.1 kg (300 lb.) Si—Mn deoxidized steel . . . 270-290 sec.
**The increase and/or decrease in relative amounts of the identified inclusion phases corresponds to the indicated increase in the % Ca:% Al ratio.

The various inclusion phases identified in Table III above are also superimposed on the graph shown in FIG. 1. It will be seen that in each instance where there is an abrupt change in ingot weight, there is a corresponding change in the identification of the major phases in the microscopic oxide inclusions. Again, the influence of the inclusion phases on nozzle constriction are evident.

The expression "average rate of steel flow" as used herein (FIG. 12) refers to the weight of the ingot produced per second of time that the steel flowed through the nozzle, i.e., until the flow was terminated either by nozzle blockage or drainage of the furnace and tundish. When the flow rate increased, there was a corresponding increase in the relative amount of calcium in the the aluminate phases, emphasizing the effect of inclusion composition of the nozzle flow-through properties of the steels. In other words, for a given aluminum content, the amount of calcium in these steels determine the rate of flow. However, it was found that the rate of flow does not reflect another effect that may be of considerably significance in actual practice. Thus, when small amounts of calcium are added to aluminum-deoxidized steels, nozzle blockage actually increases. For example, at low %Ca/%Al ratios in the tundish, less than 0.115, the steel flowed at a rapid rate but only for a short period of time. The ingot weights and times of casting decreased and frequently the greater decrease was in the casting time. As a result, the rate of flow, kilograms per second, increased even though the ingots weighed less than the ingots from the calcium-free, aluminum-deoxidized steel. For this reason, it is necessary to discuss the correlation of the inclusion characteristics, tundish chemistry and ingot weights instead of the flow rate.

Figure 3:
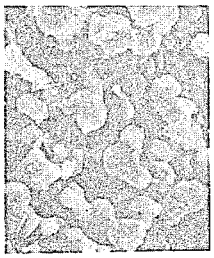

As the ratio of the calcium and aluminum contents in the tundish increased from 0.0070 to 0.0085, the alumina precipitate (FIG. 2) was gradually replaced with the $CaO.6Al_2O_3$ phase. The times of flow decreased from 205 to as low as 34 seconds and the ingot weight from a maximum of 45.4 kg (100 lb.) to a minimum of 9 kg (20 lb.). As shown in FIG. 1, the severe blockage continued until the ratio exceeded 0.10. In the ratio interval of 0.0085 to 0.10, the flow of steel was consistently poor and appreciably less than for aluminum-deoxidized steels. The average ingot weight was 13.6 kg (30 lb.) or 10% of the furnace charge; and the rate of flow was rapid but of short duration. The relative amounts of calcium and aluminum in the inclusions precipitated in the nozzle were characteristic of the $CaO.6Al_2O_3$ phase as shown in the photomicrograph of FIG. 3.

The high solidification temperatures of $Al_2O_3$ and $CaO.6Al_2O_3$, i.e., 2050° C. and 1850° C., respectively, ensure that these inclusion phases will produce nozzle blockage. Both are solid at steelmaking temperatures. In addition, there is a 14 percent increase in inclusion volume when $CaO.6Al_3O_3$ forms instead of $Al_2O_3$. As a result, the severity of a nozzle blockage increases when small amounts of calcium are added to aluminum-deoxidized steels and the $CaO.6Al_2O_3$ inclusion phase forms instead of $Al_2O_3$. The nozzle flow properties of the aluminim deoxidized steels did not improve until the ratio of the calcium and aluminum contents in the tundish exceeded 0.115 (FIG. 1).

As the ratio increased from 0.10 to 0.14, severe blockage was eliminated and when the ratio exceeded 0.14, the tundish drained. For a given aluminum content, this ratio interval is equivalent to less than a 1.5 times increase in the amount of calcium. For example, a 1038 grade of steel containing 0.039% aluminum and 44 ppm calcium clogged the nozzle after casting an ingot weighing 31 kg (69 lb.) but, in a steel containing 0.034% aluminum and 69 ppm calcium, the tundish drained and the ingot weight 135.2 kg (298 lb.). The inclusions precipitated in the blocked nozzle were primarily $CaO.6Al_2O_3$ and in a specimen from the 135.2 kg (298 lb.) ingot, $CaO.2Al_2O_3$ and $CaO.Al_2O_3$.

Figure 4:
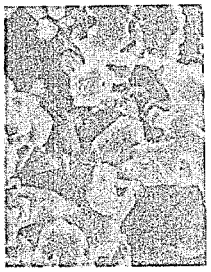
Figure 5:
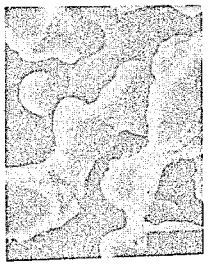
Figure 6:
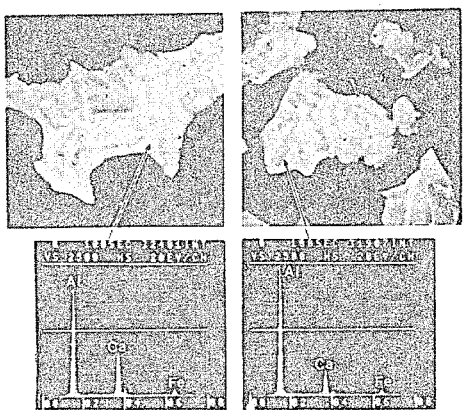

In the ratio range of 0.10 to 0.13, the inclusions precipitated in the nozzles usually had the morphology of the major inclusion phase. For example, the hexagonal symmetry of the inclusion shown in the photomicrograph of FIG. 4 is characteristic of the $CaO.6Al_2O_3$ phase while the globular shape of the inclusions shown in the photomicrograph of FIG. 5 is characteristic of the $CaO.2Al_2O_3$ phase. It should be noted that these precipitates are not single phase. In fact, all of the nozzle clogging precipitates formed in these steels, %Ca/%Al=0.10 to 0.13, were a closely associated mixture of $CaO.6Al_2O_3$ and $CaO.2Al_2O_3$ phases. A ty ical two-phase inclusion precipitate is seen in the photomicrograph of FIG. 6 where the darker gray, idiomorphic crystals are the primary phase, $CaO.6Al_2O_3$ and the lighter gray matrix is a fine-grained eutectic-type mixture of $CaO.6Al_2O_3$ and $CaO.2Al_2O_3$. Based on a correlation of ingot weights and estimated amounts of the $CaO.6Al_2O_3$ in the nozzle precipitate, it was concluded that the severity of the nozzle blockage diminished as the amount of the inclusion phase, $CaO.6Al_2O_3$, decreased.

Between the tundish ratio interval of 0.13 to 0.14, the nozzle blocked after casting 127 kg (280 lb.) to 133.4 kg (294 lb.) of the 136.1 kg (300 lb.) charge. Thus, the tundish was about two-thirds full when the blockage occured indicating that the ferrostatic head, 11.4 cm (4.5 in.), was not sufficient to maintain flow. Initially, it was expected that more severe blockage might occur since the major inclusion phase detected in these nozzle precipitates was $CaO.2Al_2O_3$. When this phase forms in the pure state, in a three-component system (Ca-Al-O) and under equalibrium cooling conditions, it is solid at steelmaking temperatures. However, when it forms as an inclusion phase in a multicomponent system under steelmaking conditions, it precipitates in a semi-solid or liquid state as evidence by the spherical shape shown in the photmicrograph of FIG. 7. Thus its effect on nozzle blockage is minimal.

Since the nozzles blocked only with a reduced ferrostatic head when $CaO.2Al_2O_3$ was the major inclusion phase, it is doubtful if blockage will occur in commercial practice at these concentrations of calcium and aluminum, e.g., %Ca/%Al=0.13 to 0.14. In a steel containing 0.045% aluminum, this is equivalent to 59 to 63 ppm calcium. As the ratio was increased from 0.14 to 0.28, not only was blockage eliminated but there was also a corresponding decrease in the time required to cast the 136.1 kg (300 lb.) furnace charge. At ratios greater than 0.22, the time to drain the tundish was comparable to that of a steel deoxidized with silicon plus manganese. This agrees with the earlier observation, i.e., the fluidity of steels increases with the addition of calcium.

The only oxide inclusions detected in these 133.8 kg (295 lb.) to 136.1 kg (300 lb.) ingots were a mixture of $CaO.2Al_2O_3$ and $CaO.Al_2O_3$-type phases. Both phases were present in the same heats, usually in the same inclusions, and their average relative amounts varied with the tundish ratio is shown in FIGS. 8 to 10. When the ratio exceeded 0.15 the inclusions contained CaS in addition to the $CaO.2Al_2O_3$ and $CaO.Al_2O_3$. The only exception found is shown in the photomicrograph of FIG. 9 where one of the inclusions contained some $CaO.6Al_2O_3$. The CaS phase apparently formed by precipitation from liquid calcium-and sulfur-enriched aluminate inclusions during cooling.

In another experiment, a steel melt containing 90 ppm calcium and 0.047% aluminum was found to clog the nozzle early during the casting operation. The ingot weight was 75.8 kg (167 lb.) and the drainage time was 300 seconds. The nozzle precipitate consisted of small volumes of calcium sulfide dispersed in a $MgO.Al_2O_3$ matrix indicating that the melt had been contaminated with magnesium reduced from the crucible. The electron image taken on this precipitate sample is shown in the photomicrograph of FIG. 11. Subsequent analysis of the steel remaining in the tundish indicated a magnesium content in excess of 6 ppm, an amount sufficient to form $MgO.Al_2O_3$ in aluminum-deoxidized steels. Since the solidification temperature of $MgO.Al_2O_3$ is 2135° C., the nozzle clogged even though the steel was enriched in calcium.

The effect of calcium addition on the "relative flowability" of steels containing known amounts of aluminim can be estimated from the experimental data obtained in these tests. The term "relative flowability" may be defined as the percentage of the steel in the furnace charge that flowed through the nozzle. Estimated values of relative flowability are listed in Table VI below.

TABLE IV

Relative Flowability of Steel Containing Indicated Amounts of Calcium and Aluminum in the Tundish - Calculated

| Aluminum (%) | | | | |
|---|---|---|---|---|
| 0.01 | 0.02 | 0.03 | 0.04 | Relative Flowability |
| Calcium (ppm) | | | | |
| 0 | 0 | 0 | 0 | 29 |
| .8 | 1.6 | 2.4 | 3.2 | 15 |
| 2.0 | 4.0 | 6.0 | 8.0 | 10 |
| 10 | 20 | 30 | 40 | 10 |
| 11.5 | 23 | 34.5 | 46 | 29 |
| 13 | 26 | 39 | 52 | 93 |
| 14 | 28 | 42 | 55 | 100 |
| >15 | >30 | >45 | >60 | 100 |

It will be seen from the foregoing that the present invention provides an improved process for continuous casting of an aluminum-deoxidized steel wherein calcium is added to the melt in amounts which are effective to insure good flowability during the casting operation and also to avoid nozzle blockage. The improved process can be carried out even though the aluminum content in the molten steel may vary substantially so long as the calcium and aluminum ratio is maintained above a threshold level (%Ca/%Al=0.14). It will moreover be seen that since the microscopic inclusion phases that precipitate in the melt determine to a large extent the flow characteristics of the steel and further since the identity of these inclusion phases can be controlled by regulating the relative calcium and aluminum contents during casting, a very useful tool is now provided the steelmaker for controlling the casting operation by microscopic examination. Thus, the steelmaker may now examine a specimen of the molten steel, the nozzle precipitate or steel ingot itself and depending on the result of this examination, a sufficient amount of calcium can be added to succeeding steel melts which will prevent the formation of the $CaO.6Al_2O_3$ phase and thereby insure good flowability and also eliminate the possibility of nozzle blockage.

What is claimed is:

1. An improved process for continuous casting of an aluminum-deoxidized steel which comprises: adding to the molten steel an amount of calcium or calcium-bearing material which is sufficient to establish a calcium concentration exceeding the aluminum content by a value greater than about 0.14 and then directing the molten steel through a nozzle and continously casting the molten steel into the desired shape.

2. The improved method according to claim 1 wherein the established calcium concentration exceeds the aluminum content in the steel by a value greater than 0.22.

3. The improved process according to claim 1 wherein the molten steel contains less than about 6 ppm of magnesium.

4. In the continuous casting of an aluminum-deoxidized steel wherein a steel charge is melted in a furnace and the molten steel directed to a tundish having a nozzle and wherein the molten steel is cast through the nozzle into ingots of desired shape; the improvement whereby blockage of the nozzle by precipitated oxide inclusions is eliminated, said improvement comprising examining the oxide inclusions microscopically to identify the contained inclusion phases and adding to the molten steel a sufficient amount of calcium to prevent the formation of $CaO.6Al_2O_3$ inclusions during the casting operation.

5. The improvement according the claim 4 wherein a sample of the molten metal is microscopically examined to identify the presence of the $CaO.6Al_2O_3$ phase.

6. The improvement according to claim 4 wherein a sample of the nozzle precipitate is microscopically examined to identify the presence of the $CaO.6Al_2O_3$ phase.

7. The improvement according to claim 4 wherein a sample of the cast ingot is microscopically examined to identify the presence of the $CaO.6Al_2O_3$ phase.

* * * * *

UNITED STATES PATENT AND TRADEMARK OFFICE

CERTIFICATE OF CORRECTION

PATENT NO. : 4,317,678

DATED : March 2, 1982

INVENTOR(S) : Gloria M. Faulring and Donald C. Hilty

It is certified that error appears in the above-identified patent and that said Letters Patent are hereby corrected as shown below:

Column 1, line 14, change "refer" to --referred--.

Column 1, lines 31-32, change "manufacturering" to --manufacturing--.

Column 1, line 45, change "deoxiderizer" to --deoxidizer--.

Column 1, line 59, change "benefical" to --beneficial--.

Column 2, lines 18-19, change "dexoidized" to --deoxidized--.

Column 2, line 36, change "conprises" to --comprises--.

Column 3, line 53, change "maybe" to --may be--.

Column 4, line 45, change "simular" to --similar--.

Column 5, line 23, change "0.68.0.91" to --0.68-0.91--.

Column 5, line 24, change "0.75.0.92" to --0.75-0.92--.

Column 5, line 27, change "date" to --data--.

Column 5, line 38, change "Tundis" to --Tundish--.

UNITED STATES PATENT AND TRADEMARK OFFICE

CERTIFICATE OF CORRECTION

PATENT NO. : 4,317,678

DATED : March 2, 1982

INVENTOR(S) : Gloria M. Faulring and Donald C. Hilty

It is certified that error appears in the above-identified patent and that said Letters Patent are hereby corrected as shown below:

Column 7, lines 38-39, change "considerably" to --considerable--.

Column 8, line 40, change "weight" to --weighed--.

Column 8, line 23, change "$CaO.6Al_3O_3$" to --$CaO.6Al_2O_3$--.

Column 9, line 8, change "equalibrium" to --equilibrium--.

Column 9, lines 67-68, delete "Table VI below" and substitute therefor --Table IV below--.

Column 11, line 5, after the word "according", delete "the" and substitute --to--.

Signed and Sealed this

*Fifth* Day of *November 1985*

[SEAL]

*Attest:*

*Attesting Officer*

DONALD J. QUIGG

*Commissioner of Patents and Trademarks*